US006553851B1

(12) United States Patent
Carrico et al.

(10) Patent No.: US 6,553,851 B1
(45) Date of Patent: Apr. 29, 2003

(54) EXIT SIGN AND EMERGENCY LIGHT TESTING-CLAMP

(76) Inventors: Paul I. Carrico, 12623 Crest Knolls Ct., San Diego, CA (US) 92130; Daniel B. Borchardt, 12623 Crest Knolls Ct., San Diego, CA (US) 92130

( * ) Notice: Subject to any disclaimer, the term of this patent is extended or adjusted under 35 U.S.C. 154(b) by 55 days.

(21) Appl. No.: 09/669,197

(22) Filed: Sep. 25, 2000

(51) Int. Cl.[7] ..... B25B 1/20; B25B 5/14

(52) U.S. Cl. ..... 73/865.9; 24/455; 24/545; 24/558

(58) Field of Search ..... 269/182; 248/231.71; 24/455–569; 73/865.9

(56) References Cited

U.S. PATENT DOCUMENTS

| | | | | | |
|---|---|---|---|---|---|
| 1,452,384 | A | | 4/1923 | Kissendorfer | |
| 3,704,014 | A | * | 11/1972 | Keene | 269/249 |
| D271,939 | S | * | 12/1983 | Little | D8/73 |
| 4,691,907 | A | * | 9/1987 | Yang | 269/152 |
| D348,816 | S | * | 7/1994 | Degen | D8/73 |
| 5,857,658 | A | | 1/1999 | Niemiec | 248/534 |
| 5,892,344 | A | | 4/1999 | Cooley | 24/455 |
| 6,098,973 | A | | 8/2000 | Khachatoorian | 269/182 |
| 6,119,992 | A | * | 9/2000 | Stuart | 248/231.71 |

* cited by examiner

*Primary Examiner*—Daniel S. Larkin
*Assistant Examiner*—David Rogers

(57) ABSTRACT

A clamping device is used to push a test button on an exit sign or emergency light. The clamp can be attached without damaging various signs and lights. The clamp includes a channel (40), which guides an adjustable protruding object to push a test button located on the bottom of the exit sign or emergency light. The clamp can test exit signs and emergency lights that are wall mounted by modifying the base (10) with a flat back (130). The clamp can also be used in conjunction with an extension arm (90) to reach test buttons located at a distance from the bottom.

4 Claims, 9 Drawing Sheets

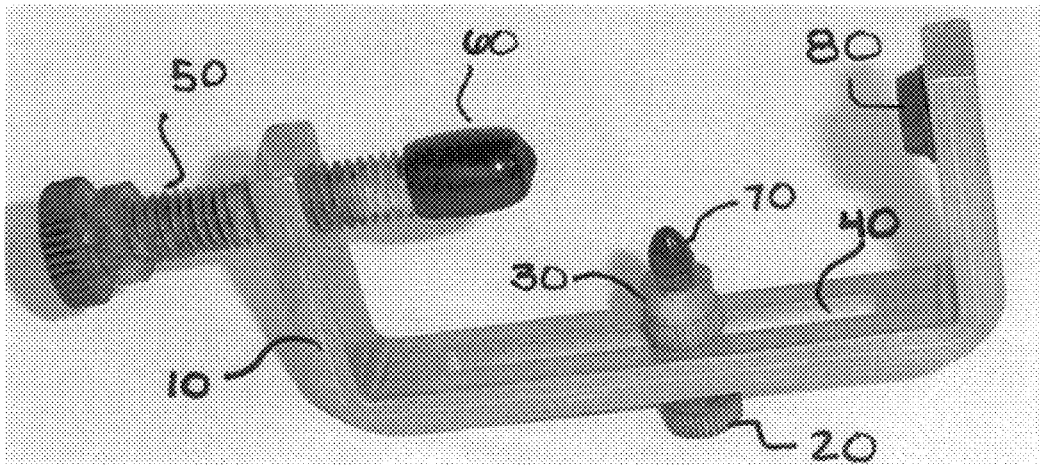
FIG 1 – A
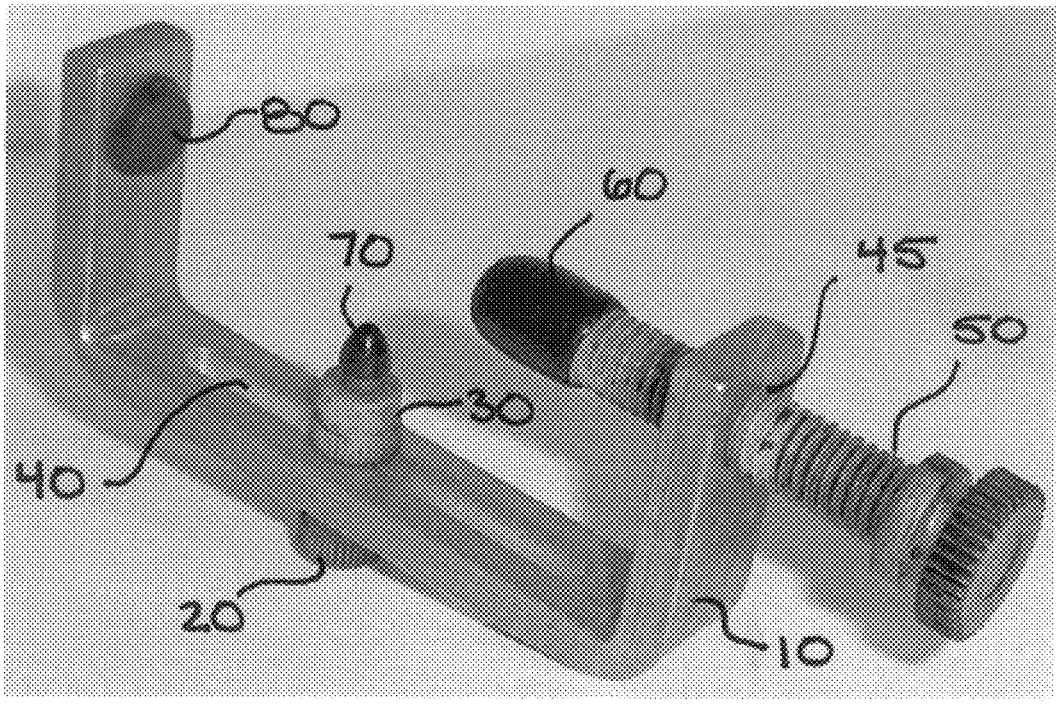
FIG 1 – B

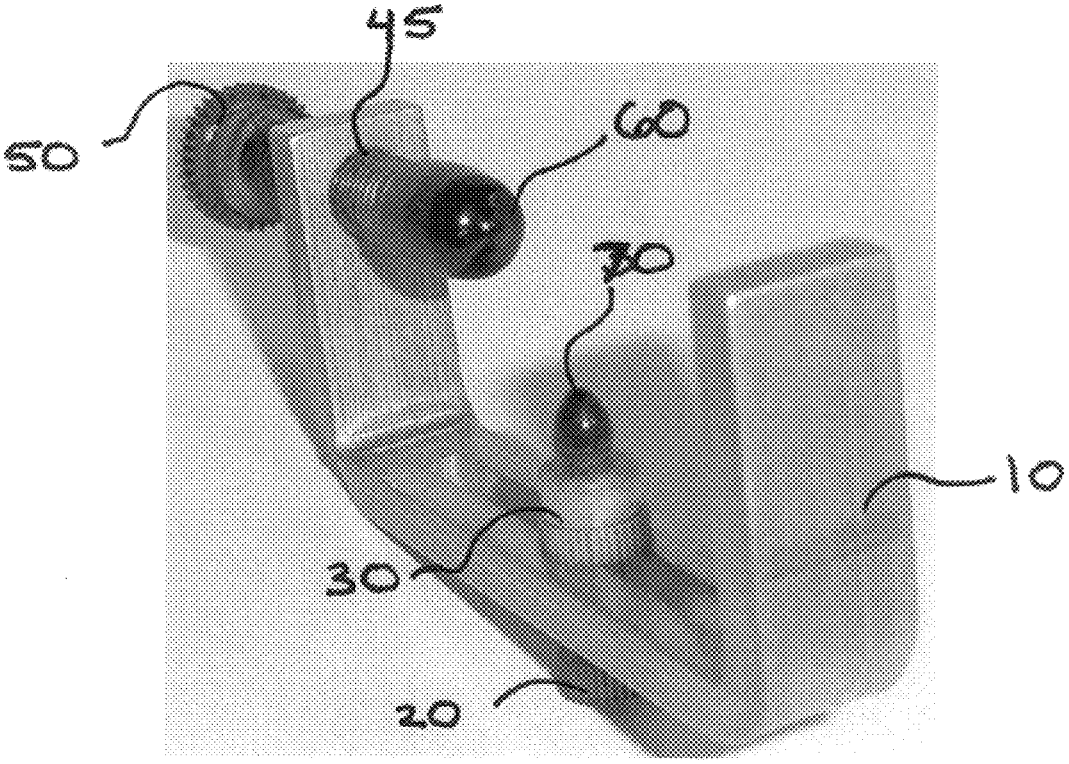
FIG 1 – C
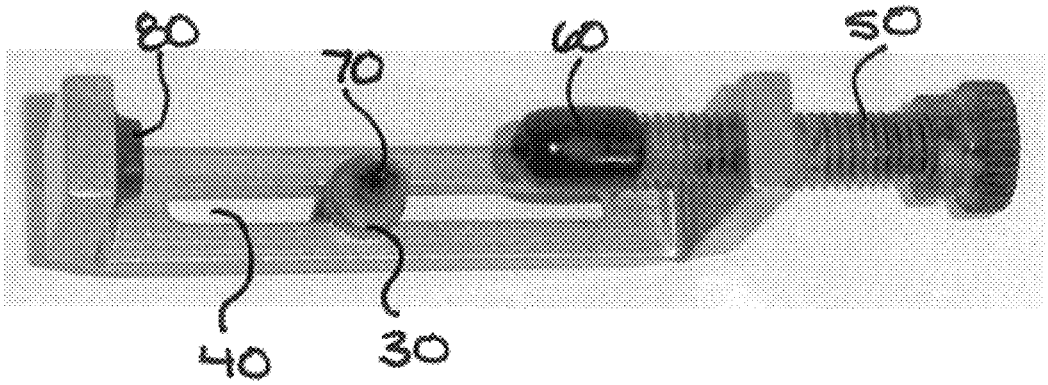
FIG 1 – D

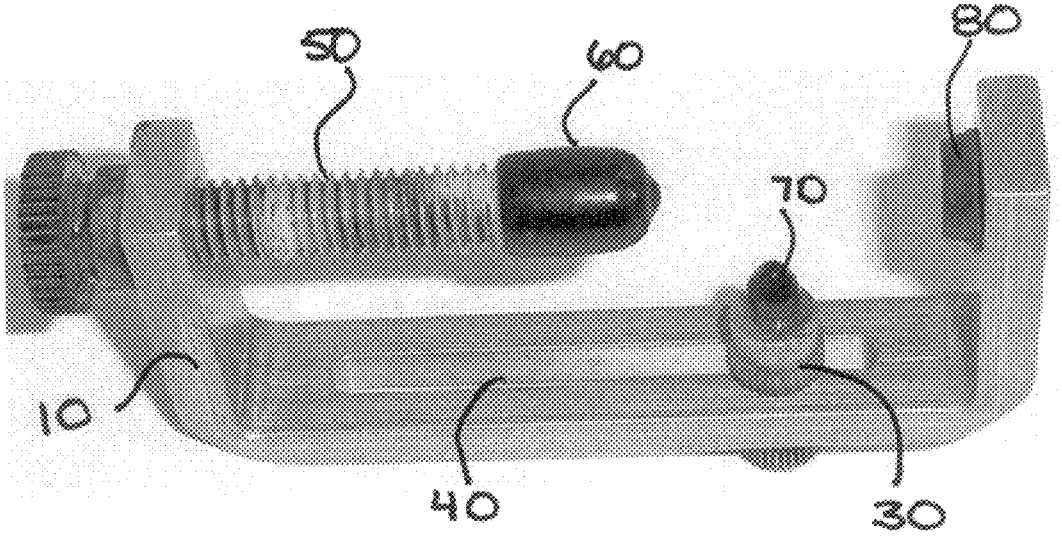
FIG 2 –A
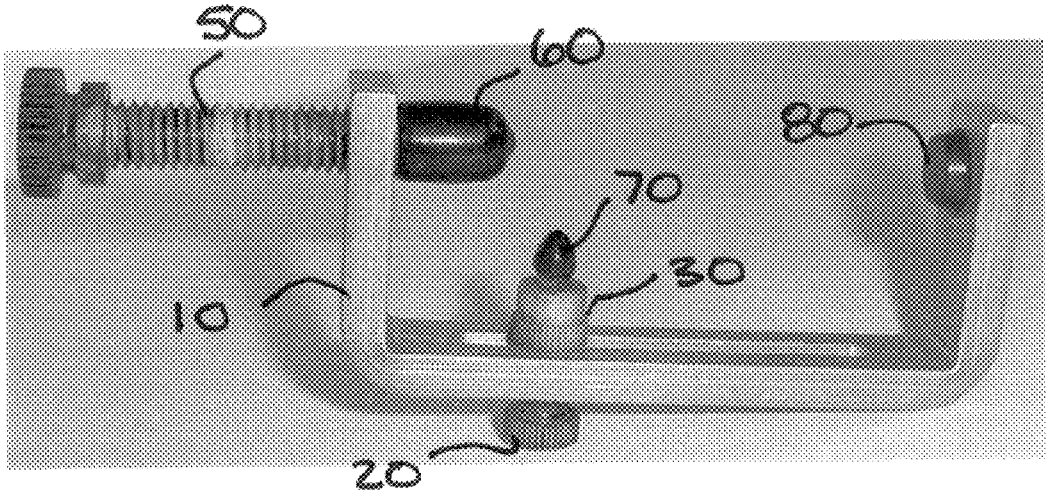
FIG 2 – B

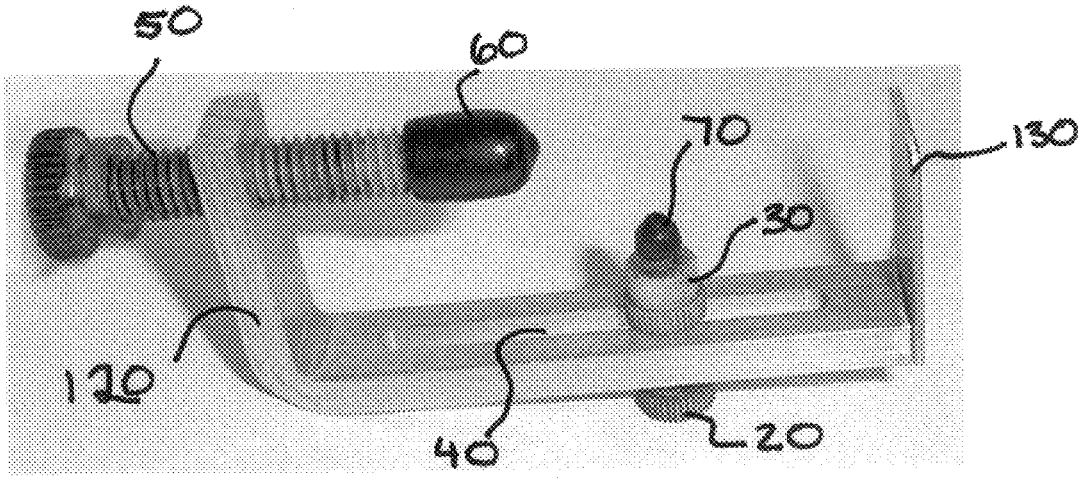
FIG 3 – A
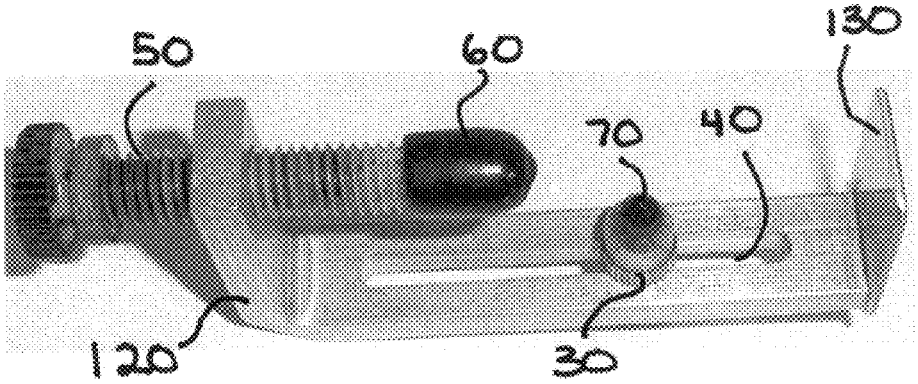
FIG 3 – B

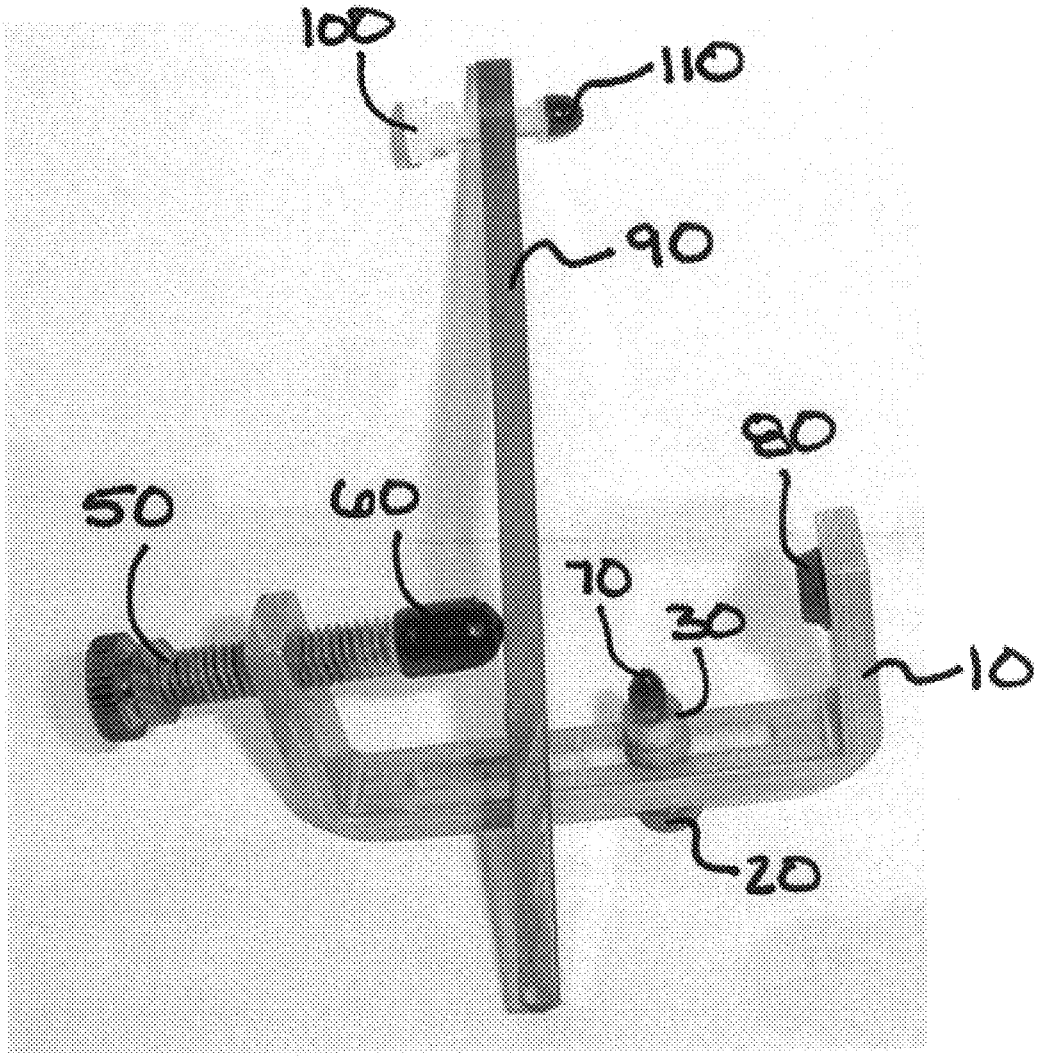
FIG 4 – A

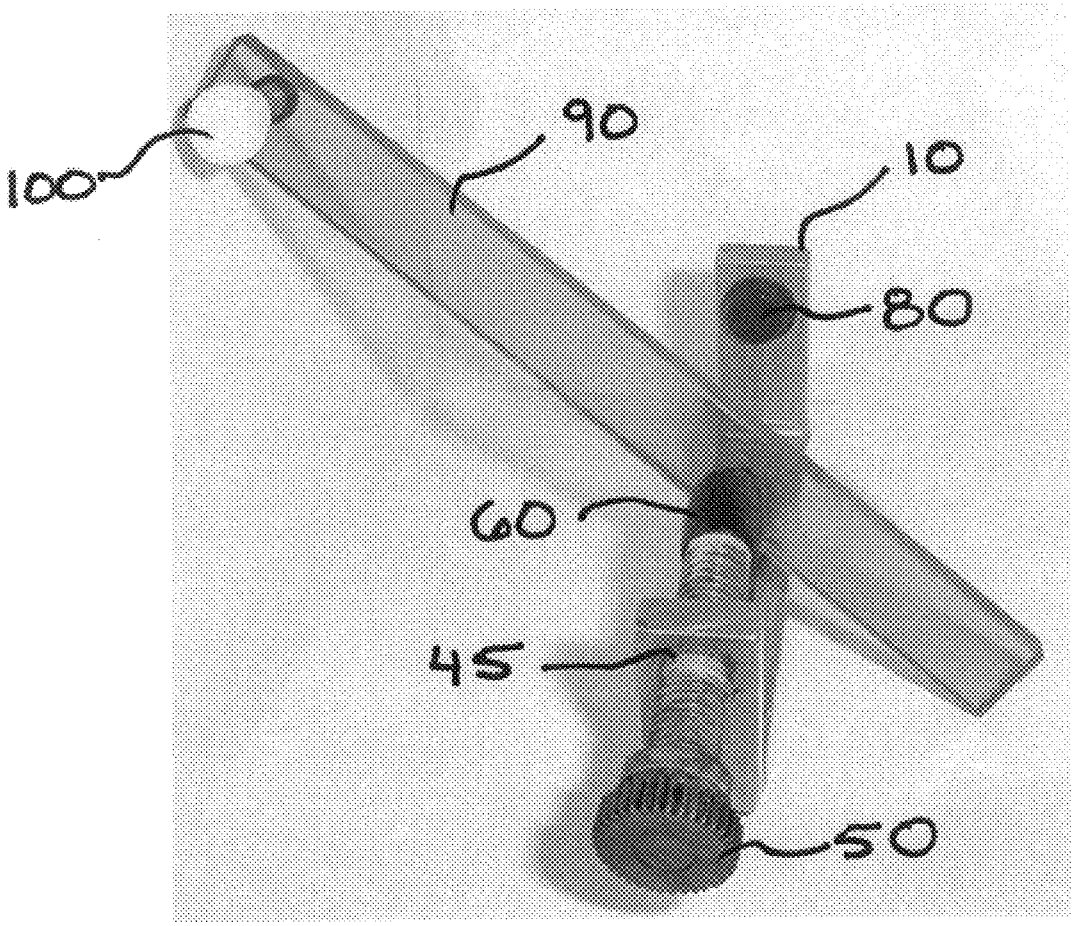
FIG 4 – B

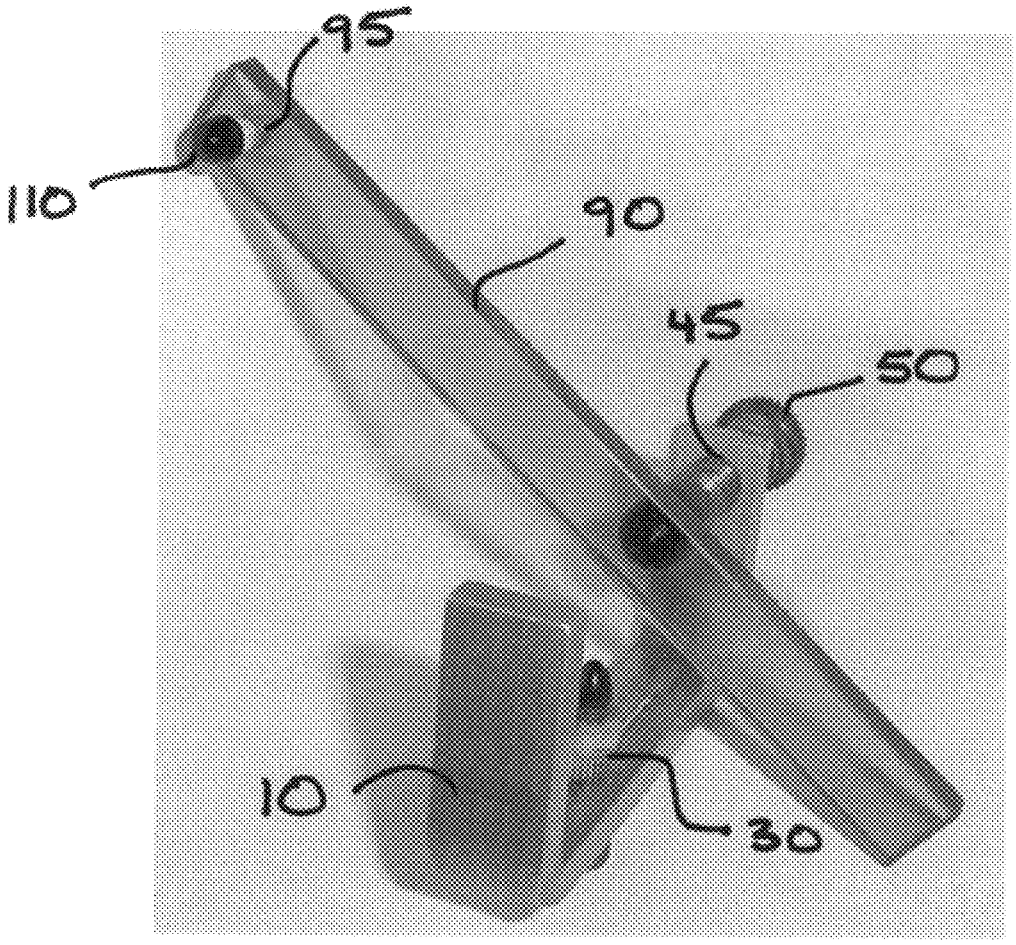
FIG 4 – C

TYPICAL
EXIT SIGN

EXIT SIGN AND EMERGENCY LIGHT TESTING-CLAMP

CROSSREFERENCE TO RELATED APPLICATION

Not applicable.

BACKGROUND

1. Field of Invention

This invention relates to exit signs and emergency lights, a device specifically to push a test button located on most of these devices.

2. Description of Prior Art

Most buildings require exit signs and emergency lights to direct individuals out of the building in an emergency. These signs and lights are to be tested in order to check that they function properly in the event of an emergency. A test button is located on most of these devices in various locations. By pressing the test button, the sign or light switches to test mode.

There are currently no clamps or tools designed specifically for this application. One method available is to physically hold the button or to tape the button down. Many existing clamping devices are not designed to work with test buttons located on the bottom or sides of an exit sign or emergency light.

A conventional clamp comprises a generally c-shaped frame having first end provided with a threaded bore and a second, opposite end provided with a flat object engaging surface. An elongated threaded screw is threadably relievable within the threaded bore. C-shaped, u-shaped and l-shaped clamps lack specific protruding parts. These type of clamps damage the sign and light and are unable to reach the test button.

Our exit sign and emergency light testing-clamp can push the test button for any period of time.

SUMMARY

In accordance with the present invention an exit sign and emergency light testing-clamp comprises of an u-shaped tool that can attach and press the testing button on an exit sign or emergency light.

OBJECTS AND ADVANTAGES

Accordingly, besides the objects and advantages of the exit sign and emergency light testing-clamp described in my above patent, several objects and advantages of the present invention are:

(a) to provide a new tool to test emergency light and exit signs according to local building and safety codes.

(b) to provide a tool to hold a test button on the emergency light and exit signs for any length of time, thus eliminating the need to stand and wait.

(c) to provide a tool that will not damage the exterior of the exit sign and exit light.

(d) to provide a method so that many exit signs and emergency light can be tested at one location using multiple testing-clamps.

Further objects and advantages are to provide a method to meet the standard building codes requiring a 90-minute test of exit signs and emergency lights. This test can now be performed using this tool. The codes that govern testing of exit signs and emergency lights are listed in the following references: 1) Standard Fire Prevention Code 1999, 807.1.4 Exit Illumination and Signs; 2) Occupational Safety and Health Administration—Department of Labor, section 1910.36; 3) National Fire Protection Agency 101–1997 edition, section 5-9.3; and many locals codes. Still further objects and advantages will become apparent from a consideration of the ensuing description.

DRAWING FIGURES

In the drawings, closely related figures have the same number but different alphabetic suffixes FIGS. 1A to 1D shows various aspects of a testing-clamp from a side view, front view, back view and top view.

FIGS. 2A to 2B shows a similar testing-clamp with movable parts adjusted FIGS. 3A to 3B shows a modified testing-clamp with similar parts and adjusted base.

FIGS. 4A to 4C shows a testing-clamp with an extension arm with a side view, front view, and back view.

Reference Numerals in Drawings

Figure 5:
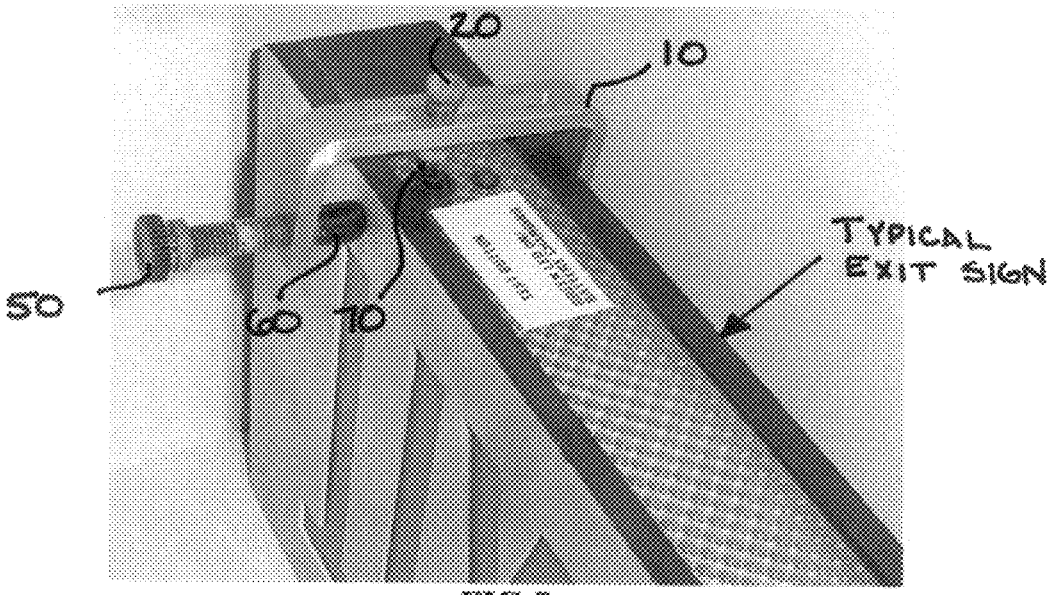
FIG. 5 shows a testing-clamp attached to a typical exit light

| | | | |
|---|---|---|---|
| 10 | u-shaped base | 70 | push button bolt cap |
| 20 | push button bolt | 80 | base inside gripper |
| 30 | push button nut | 90 | extension arm |
| 40 | channel | 95 | extension arm hole |
| 45 | hole | 100 | extension arm screw |
| 50 | main bolt | 110 | extension arm cap |
| 60 | main screw cap | 120 | L-shaped base |
| | | 130 | flat back |

DESCRIPTION—FIGS. 1A–1D—Preferred Embodiment

A preferred embodiment of the testing-clamp of the present invention is illustrated in FIG. 1-A(side view), FIG. 1B (front view), FIG. 1C (back view), and FIG. 1-D (top view). The testing-clamp is an u-shaped base 10 consisting of a metal, such as aluminum, and has overall dimensions roughly 40 mm in height×90 mm in length×15 mm in width. However the u-shaped base can consist of any other material that can be rigid such as plastic or nylon and the dimension can vary as needed. Attached to the base on the inside is a gripping device 80. This is a rubber material that protects and grips a device in the testing-clamp.

Cut into the base 10 is a longitudinal channel 40 and has a dimension of roughly 60 mm lenght×6 mm wide. Connected to the base through this longitudinal channel 40 are a bolt 20 and a nut 30. These two parts slide along the longitudinal channel 40. They can be tightened at any point thus making 20 and 30 stationary. On the top of the bolt 20 is a cap 70. The cap is rubber.

Cut into the base 10 by machining is a hole 45. This hole 45 is threaded to fit a bolt 50. A bolt 50 is 60 mm in length and made up of a rigid plastic. On the end of a bolt 50 is a cap 60 made of rubber. However, this bolt 50 can consist of other rigid materials such as nylon or various metals FIGS. 2A and 2B show the testing-clamp with adjustable parts in different positions. FIG. 2A shows a testing-clamp with bolt 50 closed position and a bolt 20 and nut 30 moved to a back position. FIG. 2B shows a testing-clamp with a bolt 50 in an open position and a bolt 20 and nut 30 moved to a front position.

FIGS. 3A–4C—Additional Embodiments

There are various possibilities with the regard to the relative disposition of a testing-clamp. FIG. 3A shows a testing-clamp with an adjust L-shaped base 120 and an attached flat back 130 with dimensions roughly 15 mm wide×40 mm height×2mm thick; in FIG. 3B shows a similar testing-clamp from a front view.

FIGS. 4A–4C shows a testing-clamp and an extension arm 90 with dimensions roughly 15 mm wide×100 mm long×5 mm thick. Cut into an extension arm 90 by machining is a hole 95, threaded to fit a bolt 100. This bolt 100 is adjustable with a length of 25 mm and is made of a rigid plastic. On the end of a bolt 100 is a cap 110 made of rubber. However, this bolt 100 and extension arm 90 can consist of other rigid materials such as nylon or various metals.

Advantages

From the description above of additional embodiments, a number of advantages of our exit sign and emergency light testing-clamp become evident:

(a) Many different styles of exit signs and emergency light with test buttons in various locations can be tested.

(b) Exit signs and emergency lights surfaced mounted can be tested.

Operation—FIGS. 1, 3, 4, 5, 6, 7

The manner of using the exit sign and emergency light testing-clamp is shown in FIG. 5. Namely, the testing-clamp FIGS. 1A–D is attached to the exit sign or emergency light generally in a perpendicular plane by adjusting the main bolt 50. The testing-clamp is placed in a manor so that the push button bolt 20 and nut 30 is placed below the test button and secured into position. When the main bolt is tightened to secure the testing-clamp the push button exerts pressure on the test button of the exit light.

To remove the testing-clamp, one must loosen the main bolt 50 until the testing-clamp slides off the emergency light or exit sign.

Figure 6:
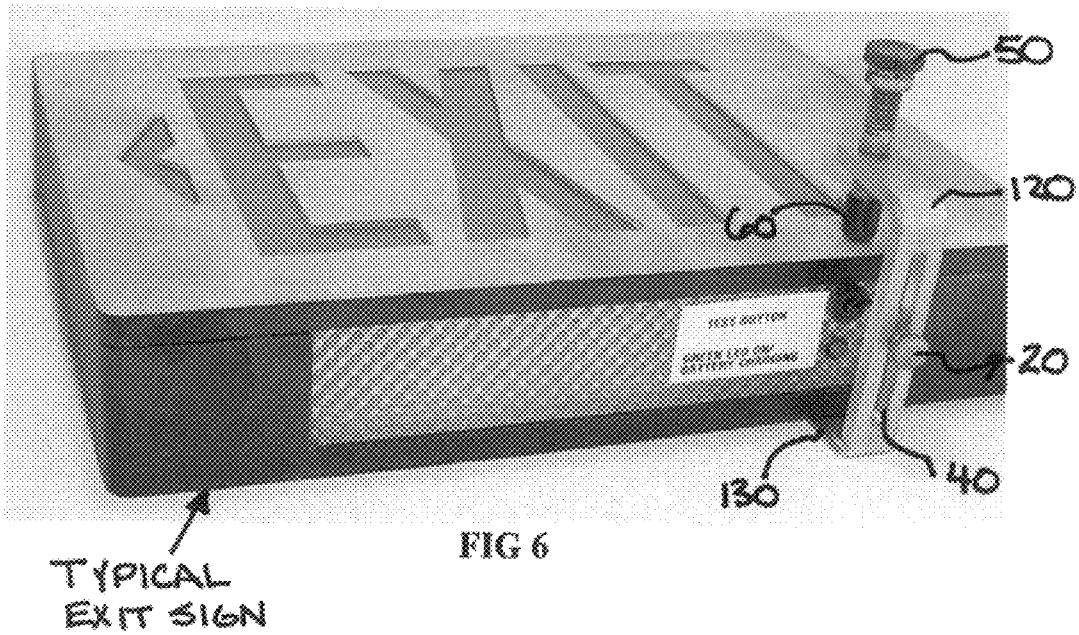
FIG. 6 shows a testing-clamp attached to a surfaced mounted exit sign

As shown in FIG. 6 when an exit sign is mounted closely to a wall, testing-clamp in FIG. 3A is to be used. FIG. 3A testing-clamp is attached to the exit sign or emergency light generally in a perpendicular plane by adjusting the main bolt 50. The clamp is placed in a manor so that the push button bolt 20 and nut 30 is placed below the test button and secured into position. When the main bolt is tightened to secure the testing-clamp the push button exerts pressure on the test button of the exit light.

Figure 7:
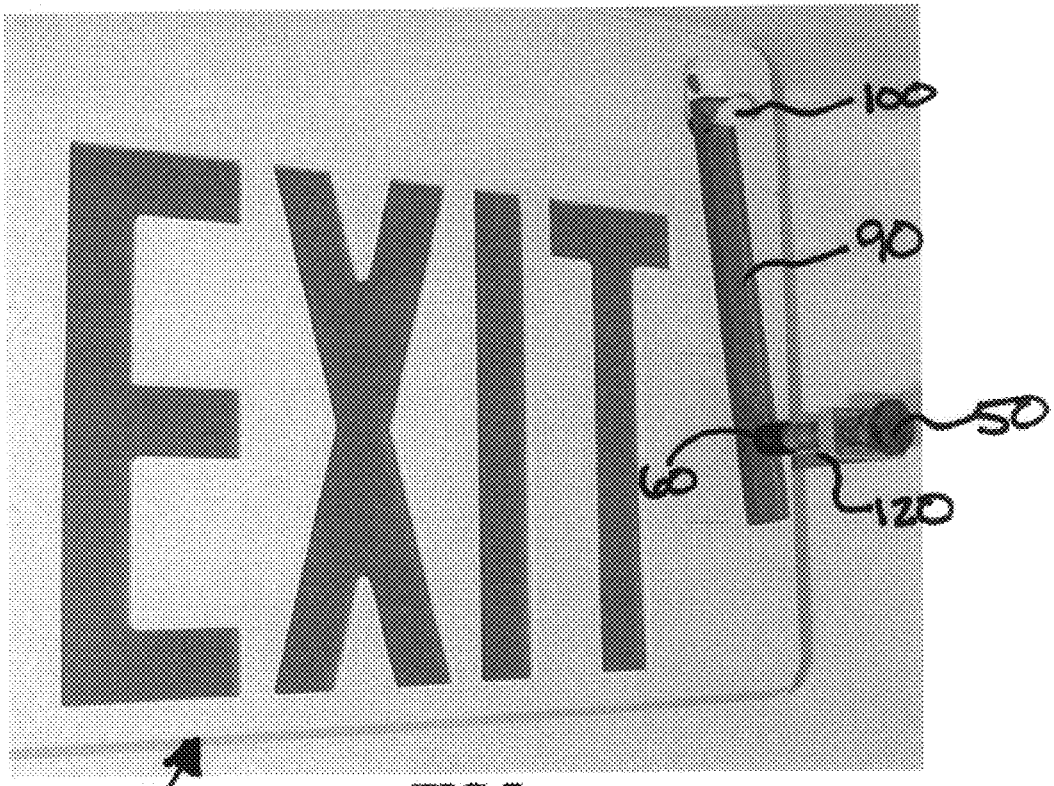
FIG. 7 shows a testing-clamp and an extension arm attached to a exit sign

As shown in FIG. 7 when an exit sign has a test button located at a distance an extension arm 90 is needed. Namely, the testing-clamp FIGS. 1A–D or FIGS. 3A–3B is attached to the exit sign or emergency light generally in a perpendicular plane by adjusting the main bolt 50. The testing-clamp is placed in a manor so that the extension arm 90 can reach the test button. When a main bolt is tightened to secure the testing-clamp the extension arm 90 and extension arm bolt 100 exerts pressure on the test button of the exit light.

Conclusion, Ramifications, and Scope

Accordingly, the reader will see that the exit sign and emergency light testing-clamp can be used to push the test button on most exit signs or emergency lights easily and conveniently. The testing-clamp can be removed just as easily and without damage to the exit sign or exit light. In addition the testing-clamp can be modified to reach test buttons located at a distance or that are mounted close to walls. Further more, the testing-clamp has the additional advantages in that it is the first tool designed for this specification application.

it is light weight and can clamp to most exit signs and exit lights.

it provides a means to reach most test buttons it holds a test button on the emergency light and exit signs for any length of time, thus eliminating the need to stand and wait.

Although the description above contains many specificities, these should not be construed as limiting the scope of the invention but as merely providing illustrations of some of the presently preferred embodiments of this innovation. For example the testing-clamp can have other colors, different sizes, and different materials, etc.

Thus the scope of the invention should be determined by the appended claims and their legal equivalents, rather than by the examples given.

We claim:

1. A method to activate a test button on an emergency exit sign or other emergency lighting systems using a clamp comprising a generally U-shaped member (10) with an elongated base, a first side, and a second side, an elongated longitudinal channel (40) formed on the lower region of the base between said first and second sides, a threaded hole formed on said first side of the base member through which a first threaded bolt (50) is attached, and a second threaded bolt (20) releasably attached to the base through the channel using a nut (30) and comprising the steps of:

(a) locating said emergency exit sign or other emergency lighting system;

(b) locating a test button on a side of said emergency exit sign or other emergency lighting system;

(c) placing said U-shaped member on said emergency exit sign or other emergency lighting system so that the U-shaped member generally surrounds said emergency exit sign or other emergency lighting system and said elongated channel is opposite said side comprising said test button; and an inner surface of said second side is in contact with said emergency exit sign or other emergency lighting system;

(d) locating by moving along said channel said second bolt directly opposite said test button;

(e) securing from further movement of said second bolt along elongated channel using said nut;

(f) moving said U-shaped base member in a direction so that said second bolt contacts with and subsequently activates said test button; and (g) turning said first threaded bolt member in a direction to releasably secure said clamp against said emergency exit sign or other emergency lighting system within said U-shaped member.

2. The method according to claim 1 further comprising the steps of:

(a) upon completion of testing, turning said first bolt in a direction to release and subsequently remove said U-shaped member from said emergency exit sign or other emergency lighting system; and (b) repeating the steps of claim 1 for additional emergency exit signs or other emergency lighting systems as required.

3. A method to activate a test button on an emergency exit sign or other emergency lighting systems using a clamp comprising a generally U-shaped member (10) with an elongated base, a first side, and a second side, an elongated longitudinal channel (40) formed on the lower region of the base between said first and second sides, a threaded hole formed on said first side of the base member through which a first threaded bolt (50) is attached, and a third threaded bolt (100) attached to a flat member (90) and comprising the steps of:

(a) locating said emergency exit sign or other emergency lighting system;

(b) locating a test button on a front or back of said emergency exit sign or other emergency lighting system;

(c) placing said U-shaped member on said emergency exit sign or other emergency lighting system so that the U-shaped member generally surrounds said emergency exit sign or other emergency lighting system and said flat member opposite said front or back comprising said test button; and locating, by moving said flat member, said third bolt directly opposite said test button;

(d) while holding said third bolt directly opposite said test button, moving an inner surface of said second side to be in contact with said emergency exit sign or other emergency lighting system;

(e) turning said first threaded bolt member in a direction to releasably secure said clamp and said flat member against said emergency exit sign or other emergency lighting system and within said U-shaped member, subsequently activating said test button.

4. The method according to claim 3 further comprising the steps of:

(a) upon completion of testing, turning said first bolt in a direction to release and subsequently remove said U-shaped member said flat member from said emergency exit sign or other emergency lighting system; and (b) repeating the steps of claim 3 additional emergency exit signs or other emergency lighting systems as required.

* * * * *